US009605809B1

(12) United States Patent
Ernst

(10) Patent No.: US 9,605,809 B1
(45) Date of Patent: Mar. 28, 2017

(54) LIGHTING MODULE WITH PAR LAMP STYLE HEAT SINK

(71) Applicant: Oliver Ernst, Peachtree City, GA (US)

(72) Inventor: Oliver Ernst, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/728,519

(22) Filed: Jun. 2, 2015

Related U.S. Application Data

(60) Provisional application No. 62/006,563, filed on Jun. 2, 2014.

(51) Int. Cl.

| | |
|---|---|
| ***F21V 29/00*** | (2015.01) |
| ***F21K 99/00*** | (2016.01) |
| ***F21S 8/02*** | (2006.01) |
| ***F21V 7/00*** | (2006.01) |
| ***F21V 7/04*** | (2006.01) |
| ***F21V 29/77*** | (2015.01) |
| ***F21V 19/00*** | (2006.01) |
| ***F21V 17/06*** | (2006.01) |
| *F21Y 101/02* | (2006.01) |

(52) U.S. Cl.
CPC ..... *F21K 9/1375* (2013.01); *F21S 8/026* (2013.01); *F21V 7/0066* (2013.01); *F21V 7/041* (2013.01); *F21V 17/06* (2013.01); *F21V 19/0035* (2013.01); *F21V 19/0065* (2013.01); *F21V 29/773* (2015.01); *F21Y 2101/02* (2013.01)

(58) Field of Classification Search
CPC .... F21K 9/1375; F21V 29/773; F21V 7/0066; F21V 7/041; F21V 17/06; F21V 19/0035; F21V 19/0065; F21S 8/026
USPC ..... 362/294
See application file for complete search history.

(56) References Cited

U.S. PATENT DOCUMENTS

| | | | | |
|---|---|---|---|---|
| 1,576,543 | A * | 3/1926 | Picker | F21V 21/02 174/62 |
| 7,677,766 | B2 * | 3/2010 | Boyer | F21K 9/00 362/249.02 |
| 7,784,969 | B2 * | 8/2010 | Reisenauer | F21V 25/10 362/294 |
| 8,047,689 | B2 * | 11/2011 | Blalock | F21V 21/02 362/362 |
| 8,142,057 | B2 * | 3/2012 | Roos | F21S 8/026 362/147 |
| 8,740,412 | B2 * | 6/2014 | Rempel | F21S 8/026 362/254 |
| 2004/0066142 | A1 * | 4/2004 | Stimac | H05B 33/0803 315/50 |
| 2007/0035951 | A1 * | 2/2007 | Tseng | F21V 33/0044 362/294 |
| 2007/0268707 | A1 * | 11/2007 | Smester | F21V 7/10 362/362 |
| 2007/0285926 | A1 * | 12/2007 | Maxik | F21V 29/006 362/294 |

(Continued)

*Primary Examiner* — Bryon T Gyllstrom
(74) *Attorney, Agent, or Firm* — King & Spalding LLP

(57) ABSTRACT

A lighting module includes a heat sink and a locking cap coupled to the heat sink at one end of the heat sink. The locking cap has retention tabs designed to retain the lighting module attached to a retention bracket. The lighting module also includes a light emitting diode (LED) light source positioned in a cavity of the heat sink and an optic positioned in the cavity of the heat sink and designed to direct light emitted by the LED light source.

20 Claims, 10 Drawing Sheets

(56) References Cited

U.S. PATENT DOCUMENTS

| | | | | |
|---|---|---|---|---|
| 2008/0158887 | A1* | 7/2008 | Zhu | F21V 29/004 362/294 |
| 2009/0086474 | A1* | 4/2009 | Chou | F21S 8/026 362/230 |
| 2011/0176316 | A1* | 7/2011 | Phipps | F21V 29/004 362/373 |
| 2012/0106176 | A1* | 5/2012 | Lopez | F21K 9/00 362/382 |
| 2012/0182744 | A1* | 7/2012 | Santiago | F21S 8/026 362/365 |
| 2013/0286646 | A1* | 10/2013 | Snell | F21V 13/04 362/231 |

* cited by examiner

LIGHTING MODULE WITH PAR LAMP STYLE HEAT SINK

RELATED APPLICATIONS

The present application claims priority to U.S. Provisional Patent Application No. 62/006,563, filed Jun. 2, 2014, and titled "LED Light Source with Par Lamp Style Heat Sink and Interchangeable Optics," the entire content of which is incorporated herein by reference.

TECHNICAL FIELD

The present disclosure relates generally to lighting fixtures, and more particularly to recessed luminaires.

BACKGROUND

Some existing lighting trims are designed for Parabolic Aluminized Reflector (PAR) incandescent lamps. For example, some lighting trims are designed for recessed installation of PAR incandescent lamps in ceilings including sloped ceilings. In some cases, the PAR incandescent lamps and corresponding trims are already installed, and it may be desirable to replace the incandescent lamps with light emitting diode (LED) light sources while retaining the existing trims. Further, LED based light sources may be preferable over incandescent lamps in new installations. In such cases, using existing trims instead of designing new trims may be more cost effective.

Thus, an LED lighting module that can be used with trims designed for PAR incandescent lamps may be desirable. Further, an LED lighting module that has field interchangeable beam forming optics and that allows light output to be varied by using drivers with different drive currents is desirable. Retention structures that enable installation of the LED lighting module in a desired position may result in desired thermal and optical performance.

SUMMARY

The present disclosure relates generally to lighting fixtures, and more particularly to recessed luminaires. In an example embodiment, a lighting module includes a heat sink. The lighting module further includes a locking cap coupled to the heat sink at one end of the heat sink. The locking cap has retention tabs designed to retain the lighting module attached to a retention bracket. The lighting module also includes a light emitting diode (LED) positioned in a cavity of the heat sink and an optic positioned in the cavity of the heat sink and designed to direct light emitted by the LED.

In another example embodiment, a lighting module includes a heat sink. The lighting module further includes a locking cap coupled to the heat sink at one end of the heat sink. The locking cap has a first retention tab and a second retention tab that are designed to retain the lighting module attached to a retention bracket. The lighting module also includes a light emitting diode (LED) positioned in a cavity of the heat sink. The lighting module further includes a retention spring. A middle portion of the retention spring is positioned between the locking cap and the heat sink. A first end portion of the retention spring and a second end portion of the retention spring extend out on opposite sides of the locking cap.

In another example embodiment, a lighting structure includes a retention bracket and a lighting module attached to the retention bracket. The lighting module includes a heat sink. The lighting module further includes a locking cap coupled to the heat sink at one end of the heat sink. The locking cap has retention tabs designed to retain the lighting module attached to a retention bracket. The lighting module also includes a light emitting diode (LED) positioned in a cavity of the heat sink and an optic positioned in the cavity of the heat sink and designed to direct light emitted by the LED.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
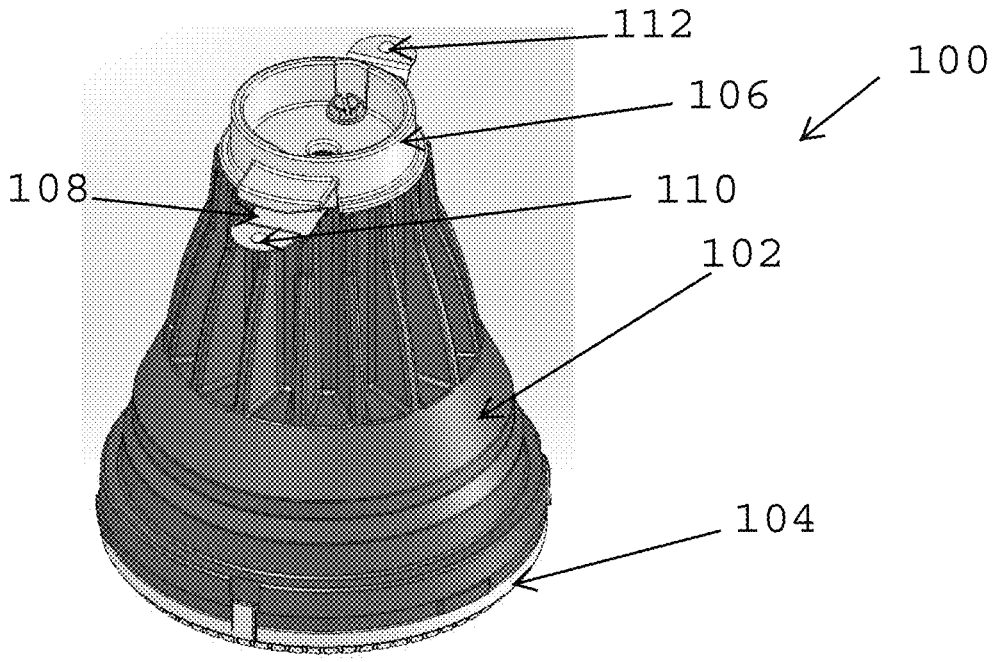
FIG. 1 illustrates a PAR lamp styled lighting module according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Turning now to the drawings, FIG. 1 illustrates a PAR lamp styled lighting module 100 according to an example embodiment. For example, the shape of the lighting module 100 may be substantially the same as or similar to a PAR 30 lamp. To illustrate, the lighting module 100 may be used with a lighting trim (e.g., a trim designed for recessed installation in a ceiling) that is designed for use with a PAR incandescent lamp.

In some example embodiments, the lighting module 100 includes a heat sink 102, an optic holder 104, and a locking cap 106. The lighting module 100 may also include a retention spring 108 that includes protrusions (indents) 110, 112. The optic holder 104 is attached to the heat sink 102 at one end of the heat sink 102. The optic holder 104 retains a beam forming optic (more clearly shown in FIG. 5) attached to the heat sink 102. In some example embodiments, the optic holder 104 may be easily detached from the heat sink 102 to allow replacement of the optic 104 with a different optic, for example, for a different lighting effect.

In some example embodiments, the lighting module 100 includes an LED light source. For example, the LED light source may include one or more LEDs that are disposed in the cavity of the heat sink 102. Power may be provided to the LEDs using electrical wires that pass through holes and/or passageways in the locking bracket 106, the retention spring 108, and the heat sink 102. The heat sink 102 is designed to dissipate heat emitted by the LEDs and associated circuitry. As illustrated in FIG. 1, the heat sink 102 may have a shape that is similar to a PAR incandescent lamp.

Figure 6:
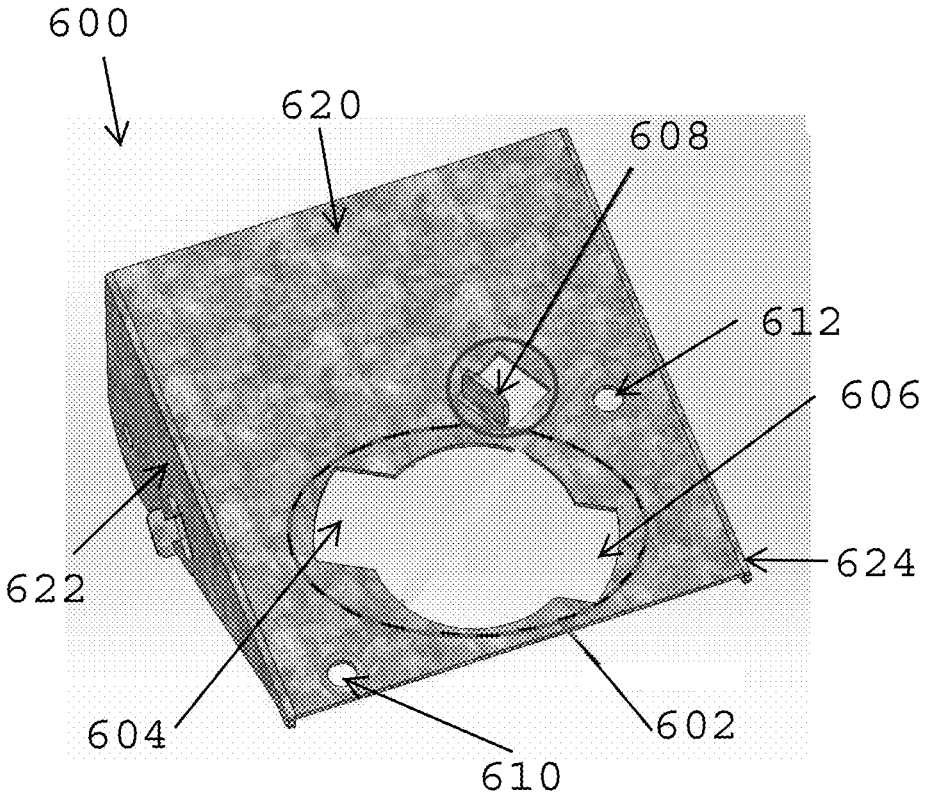
FIG. 6 illustrates a retention bracket for attachment of the lighting module of FIG. 1 according to an example embodiment.

In some example embodiments, the locking cap 106 may retain the lighting module 100 attached to a retention bracket (shown in FIG. 6). The retention spring 108 along with the locking cap 106 may provide a firm attachment of the lighting module 100 to the retention bracket as explained below. To illustrate, the retention spring 108 may pull the lighting module 100 against the retention bracket to hold the lighting module 100 firmly in place.

In some example embodiments, the protrusions 110, 112 extending up from end portions of the retention spring 108 may provide a locking mechanism that enables attachment of the heat sink 102 to the retention bracket in a predetermined desired position.

By having a shape that allows use with existing trims designed for PAR incandescent lamps, the lighting module 100 can be used as a replacement for incandescent lamps without requiring a design of new trims such recessed trims. Further, because the optic holder can be easily detached from the heat sink 102, the optic can be readily replaced, which can avoid the need to replace the entire lighting module 100.

Figure 2:
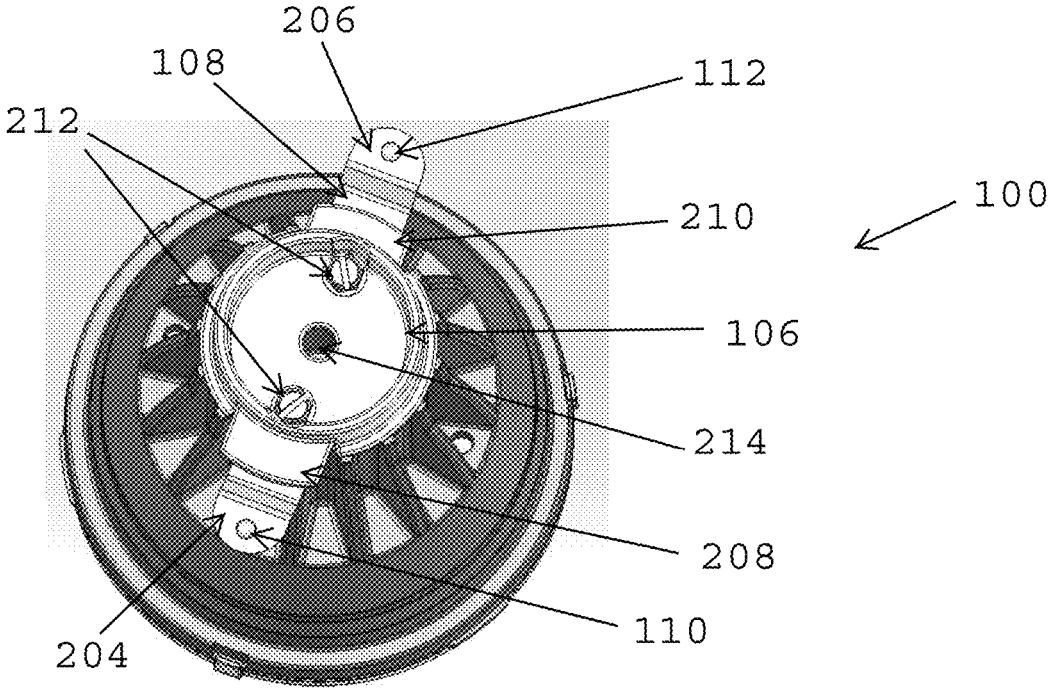
FIGS. 2-4 illustrate different views of the lighting module of FIG. 1 according to an example embodiment.
Figure 3:
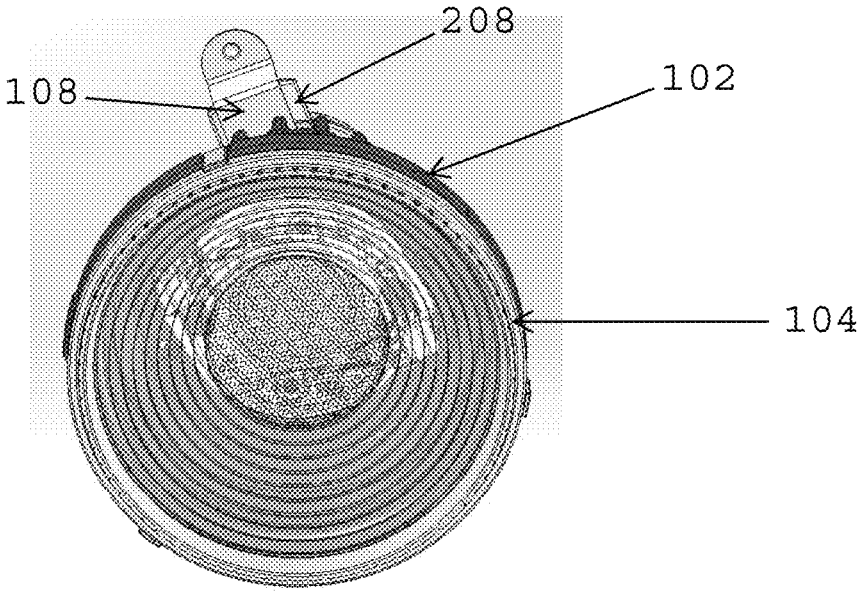
Figure 4:
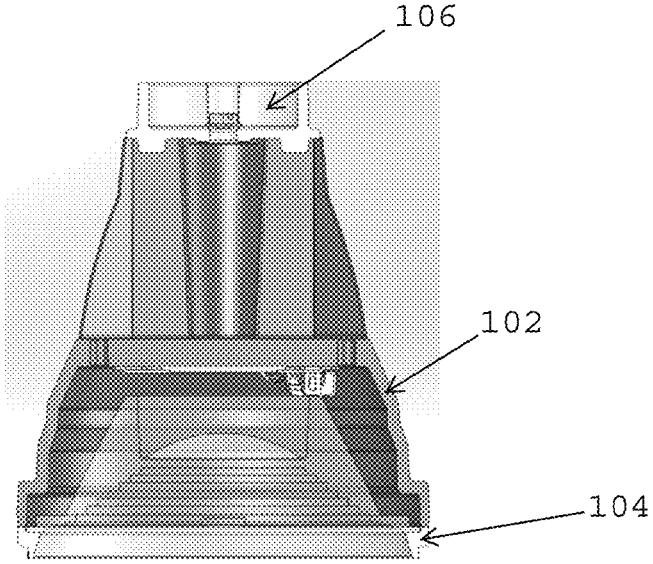

FIGS. 2-4 illustrate different views of the lighting module of FIG. 1 according to an example embodiment. Referring to FIGS. 2-4, the locking cap 106 is attached to the heat sink 102 using fasteners 212. For example, the fasteners 212 may be threaded screws that are inserted into corresponding threaded holes formed in the heat sink 102. Because a middle section of the retentions spring 108 is positioned between the locking cap 106 and the heat sink 102, the retention spring 108 may also include holes such that the fasteners 212 can reach the heat sink 102 through the holes to attach the locking cap 106 to the heat sink 102.

In some example embodiments, the locking cap 106 includes retention tabs 208, 210 that extend out outwardly from the outer perimeter of the locking cap 106. For example, the retention tab 208 may extend out horizontally on one side of the locking cap 106, and the retention tab 210 may extend out horizontally on an opposite side of the locking cap 106. The retention tabs 208, 210 are designed to retain the lighting module 100 attached to a retention bracket, such as the retention bracket shown in FIG. 6, that may be attached to a light fixture housing. In some example embodiments, the retention tab 208 may be larger than the retention tab 210. For example, the different sizes of the retention tabs 208, 210 may help orienting the lighting module 100 during attachment to a retention bracket. In some alternative embodiments, the retention tabs 208, 210 may be designed to have a different shape than shown in FIG. 2. Further, in some alternative embodiments, the locking cap 106 may include fewer or more locking tabs than shown in FIG. 2 without departing from the scope of this disclosure.

As illustrated in FIG. 2, the retention tabs 208, 210 are aligned with respective end portions 204, 206 of the retention spring 108. In some example embodiments, the retention tab 208 is aligned with the end portion 204 of the retention spring 108, and the retention tab 210 is aligned with the end portion 206 of the retention spring 108. The end portions 204, 206 of the retention spring 108 may be vertically raised as compared to the middle portion of the retention spring 108 that is between the end portions 204, 206.

Figure 8A:
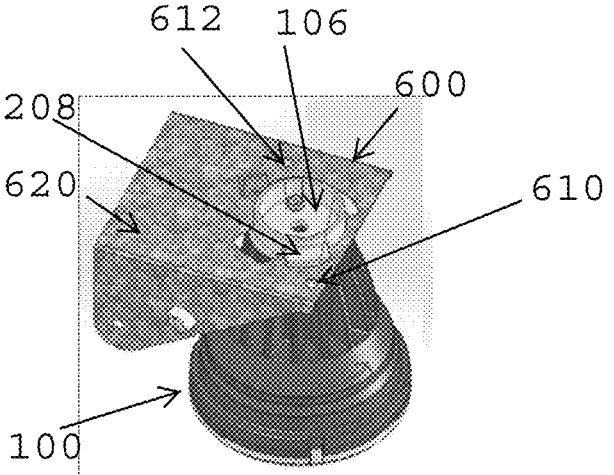
FIGS. 8A and 8B illustrate the lighting module of FIG. 1 attached to the retention bracket of FIG. 6.
Figure 8B:
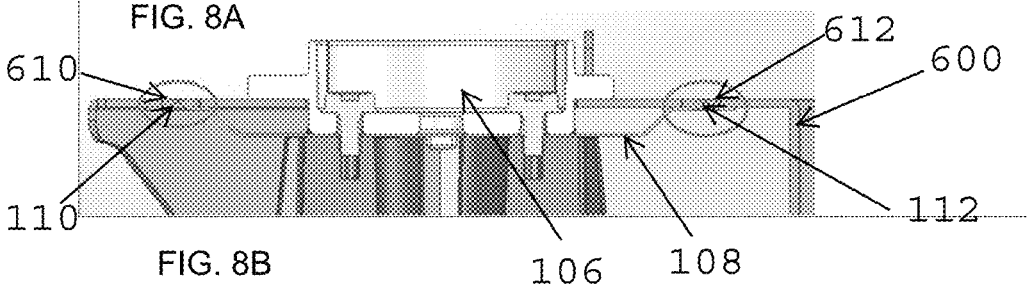

When the lighting module 100 is attached to a retention bracket, the end portions 204, 206 may come in contact with a surface of the retention bracket on one side of the retention bracket. To illustrate, the retention tabs 208, 210 and the end portions 204, 206 of the retention spring 108 are positioned on opposite sides of the retention bracket when the lighting module 100 is attached to the bracket, for example, as shown in FIGS. 8A and 8B. As explained in more detail below, the locking cap 106 and the retention spring 108 operate to firmly attach the lighting module 100 to the retention bracket. The protrusions 110, 112 extending up from the end portions 204, 206 of the retention spring 108 may lock lighting module 100 in a desired predetermined position relative to the retention bracket. As explained below, the protrusions 110, 112 are designed to fit into respective holes formed in the retention bracket.

In some example embodiments, the locking cap 106 includes a hole 214 for routing one or more electrical wires to LEDs disposed in a cavity of the heat sink 102. For example, a driver that is external to the lighting module 100 may provide power to the LEDs of the lighting module 100.

In some alternative embodiments, the lighting module 100 may have a different shape than shown in FIGS. 2-4 without departing from the scope of this disclosure. For example, the heat sink 102, the optic holder 104, the locking cap 106, and/or the retention spring 108 may have shapes other than shown in FIGS. 2-4 without departing from the scope of this disclosure.

Figure 5:
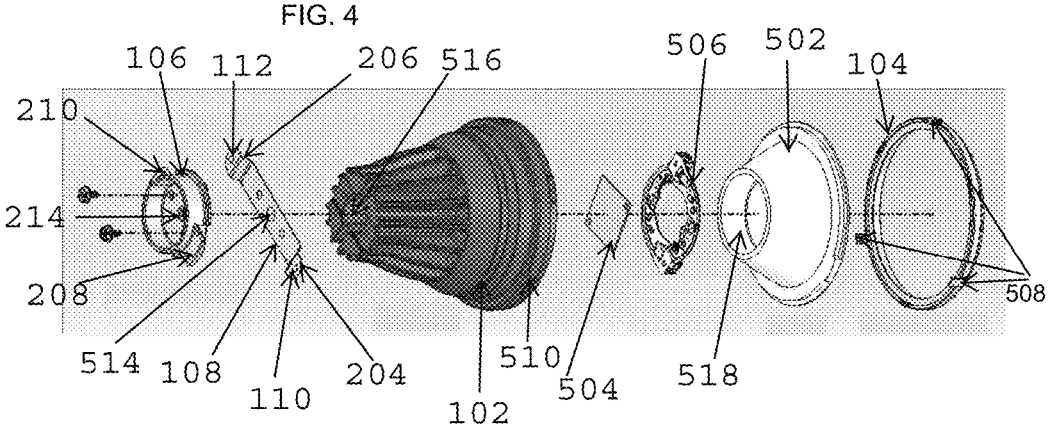
FIG. 5 illustrates an exploded view of the lighting module of FIG. 1 according to an example embodiment.

FIG. 5 illustrates an exploded view of the lighting module of FIG. 1 according to an example embodiment. As illustrated in FIG. 5, the lighting module 100 may include the heat sink 102, the optic holder 104, the locking cap 106, and the retention spring 108 that is between the heat sink 102 and the locking cap 106. The lighting module 100 may also include a beam forming optic 502 and an LED 506. The LED 506 may be one or more discrete LEDs, one or more organic light-emitting diodes (OLEDs), an LED chip on board that includes one or more discrete LEDs, an array of discrete LEDs, or another light source that may be reasonably used instead of LEDs. In some example embodiments, the lighting module 100 may also include an LED holder 506, such as a chip-on-board holder, to firmly hold the LED 504 within the cavity of the heat sink 102.

In some example embodiments, the beam forming optic 502 is designed to be positioned within a cavity of the heat sink 102. For example, the opening 518 may be positioned around the LED 504 such that the optic 502 can direct light emitted by the LED 504.

In some example embodiments, the optic 502 may be replaceable with a different optic. For example, the optic 502 may be replaced with another optic to achieve a different light distribution. To illustrate, the optic holder 104 may be a snap-on ring holder than can be easily attached and detached to/from the heat sink 102. For example, the optic holder 104 may have snap-on hooks 508 that snap onto corresponding hook receivers 510 formed in the heat sink 102. The snap-on hooks 508 may be positioned approximately 120 degrees apart around the perimeter of the optic holder 104. Alternatively, the snap-on hooks 508 may be spaced by more or less than 120 degrees. Further, in some example embodiments, the optic holder 104 may include more or fewer than three snap on hooks 508. In some alternative embodiments, the optic holder 502 may be removably attached to the heat sink 102 by other means without departing from the scope of this disclosure.

After the optic 502 is inserted into the cavity of the heat sink 102, the optic holder 104 may be snapped onto the heat sink 102 to hold the optic 502 within the cavity of the heat sink 102. Alternatively, the optic 502 may first be attached to the optic holder 104 that is then snapped onto the heat sink 102.

To replace the optic 502 with another optic, the optic holder 104 may be snapped off from the heat sink 102 and the optic 502 may be pulled out of the cavity of the heat sink 102. If the optic 502 is attached to the optic holder 104 (e.g., snapped onto the optic holder 104), the optic 502 is detached from the optic holder 104 after snapping the optic holder 104 off the heat sink 102 and pulling the optic 502 along with the optic holder 104 from the heat sink 102. After the optic 502 is removed, a replacement optic may be inserted into the cavity of the heat sink 102 and secured by the optic holder 104. The exchangeability of the optic 502 with another optic may avoid a need to replace the entire lighting module 100.

In some example embodiments, an LED driver may provide power to the LED 504. To illustrate, the locking cap 214 includes the hole 214, and the retention 108 includes a hole 514 for routing one or more electrical wires to the heat sink 102. The heat sink 102 may include a passageway 516 that allows electrical wires to be routed to the LED 504 that is in the cavity of the heat sink 102. To illustrate, one or more electrical wires may be routed through the holes 214, 514 and through the passageway 516 to the LED 504. By using an LED driver that is external to the lighting module 100, the light emitted by the LED 504 may be adjusted by controlling the LED driver. For example, a dimmer may be used to adjust the power provided to the LED 504 by the LED driver. Further, the external LED driver may be easily replaced as needed without dismantling the lighting module 100. Different LED arrays may also be used with the module.

In some example embodiments, the LED 504 may also be replaceable. For example, after the optic 502 is removed as described above, the LED 504 may be replaced with a different LED. For example, the LED 504 may be replaced to obtain a different color light, different light level, or due to damage to the LED 504. The exchangeability of the LED 504 with another LED may avoid a need to replace the entire lighting module 100.

As illustrated in FIG. 5, the end portions 204, 206 of the retention spring 108 may be offset from the middle portion of the retention spring 108 that is between the end portions 204, 206. For example, the end portions 204, 206 may be elastically pressed toward the heat sink 102 while the middle section of the retention spring 108 remains in position between the heat sink 102 and the locking cap 106.

In some example embodiments, the heat sink 102, the locking cap 106, and the retention spring 108 may be made from aluminum or other suitable material using methods such as die casting, stamping, etc. The optic holder 104 may be made from plastic or other suitable material using methods such as molding, etc.

FIG. 6 illustrates a retention bracket 600 for attachment of the lighting module 100 of FIG. 1 according to an example embodiment. The retention bracket 600 may be attached to a light fixture housing, such as a PAR incandescent light fixture housing, or another similar structure. The retention bracket 600 includes a top section 620 and side sections 622, 624 that are on opposite sides of the top section 620. The top section includes a keyhole 602, lock holes 610, 612, and a stop tab 608. The keyhole 602 is shaped such that the locking cap 106 of the lighting module 100 shown in FIG. 1 can be inserted therethrough. To illustrate, the keyhole 602 includes sections 604, 606 that are shaped and sized such that the retention tabs 208, 210 can fit through. For example, the section 604 is shaped and sized to accommodate the retention tab 208, and the section 606 is shaped and sized to accommodate the retention tab 606.

Referring to FIGS. 2 and 6, the lock holes 610, 612 are designed to receive protrusions 110, 112 from underneath the top section 620. To illustrate, after the locking cap 106 of the lighting module 100 is inserted into the keyhole 602 from underneath the top section 620, the lighting module 100 may be rotated such that the protrusion 110 is inserted into (e.g., snap into) the lock hole 110, and the protrusion 112 is inserted into (e.g., snap into) the lock hole 612. The insertion of the protrusions 110, 112 into the respective lock hole 610, 610 may indicate that the lighting module 100 is attached to the retention bracket 600 in a desired position, for example, for efficient thermal and optical performance.

In some example embodiments, the stop tab 608 may prevent over-rotation of the lighting module 100 during the attachment of the module 100 to the bracket 600. For example, after the locking cap 106 is inserted into the keyhole 602 of the retention bracket 600, the retention tab 210 may abut against an edge of the stop tab 608 if a user attempts to over rotate the lighting module 100.

The retention bracket 600 may be made from aluminum or other suitable material as may be contemplated by those of ordinary skill in the art with the benefit of this disclosure. In some alternative embodiments, the retention bracket 600 may have a different shape than shown in FIG. 6 without departing from the scope of this disclosure. Further, in some alternative embodiments, the keyhole 602 may also have a different shape than shown in FIG. 6 without departing from the scope of this disclosure. To illustrate, the keyhole 602 may have a shape that corresponds to a different shape of the locking cap 106 than shown in FIG. 1.

Figures 7A, 7B:
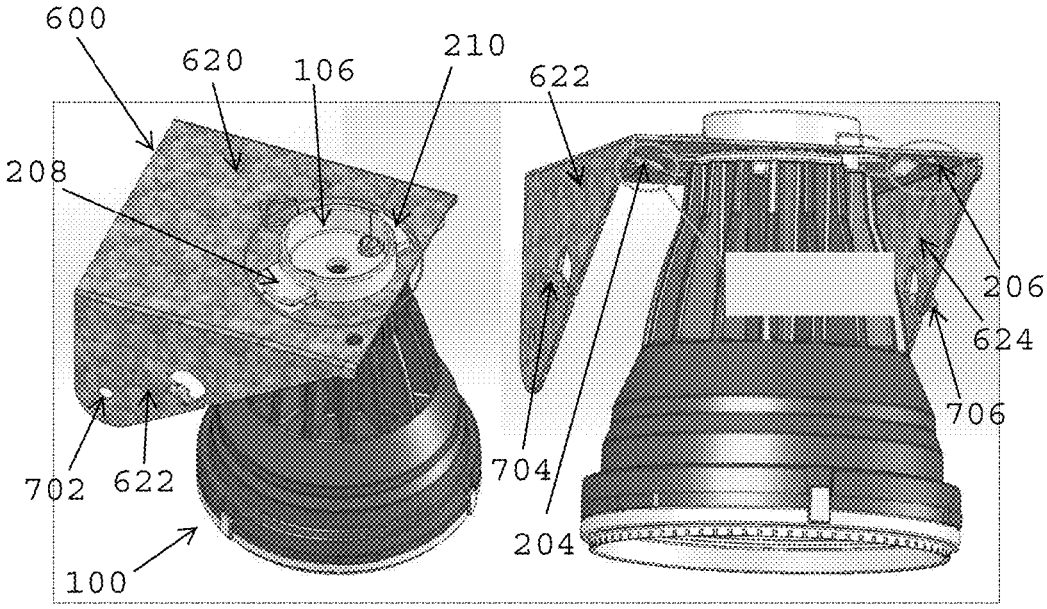
FIGS. 7A and 7B illustrate the lighting module of FIG. 1 inserted into a keyhole of the retention bracket of FIG. 6.

FIGS. 7A and 7B illustrate the lighting module 100 of FIG. 1 inserted into the keyhole 602 of the retention bracket 600 of FIG. 6. As illustrated in FIGS. 7A and 7B, the locking cap 106 is inserted into the keyhole 602. The retention tabs 208, 210 are positioned above the surface of the top section 620 of the retention bracket 600. Because the lighting module 100 has not been rotated yet, the retention tabs 208, 210 are aligned with the respective sections 604, 606 of the keyhole 602 shown in FIG. 6.

The end portions 204, 206 are in contact with a bottom surface of the top section 620 of the retention bracket 600. For example, the end portions 204, 206 may be pressed downward by the top section 620 as the lighting module 100 is pushed upward.

In some example embodiments, the retention bracket 600 may include attachment tabs 704, 706 that may be used to attach the retention bracket 600 inside a light fixture housing such as a housing designed for a PAR incandescent lamp. In some example embodiments, the retention bracket 600 may also include attachment bracket attachment hole 702 on each side section 622, 624 of the retention bracket 600.

FIGS. 8A and 8B illustrate the lighting module 100 of FIG. 1 attached to the retention bracket 600 of FIG. 6. In FIGS. 8A and 8B, the lighting module 100 has been rotated into a locked position. To illustrate, the retention tabs 208, 210 shown in FIG. 1 are no longer aligned with the sections 604, 606 of the keyhole 602 shown in FIG. 6. For example, the retention tabs 208, 210 may rest on the top section 620 of the retention bracket 600 and retain the lighting module 100 attached to the retention bracket 600.

In some example embodiments, the protrusions 110, 112 are also inserted into the respective lock holes 610, 612 in the top section 620 of the retention bracket 600. For example, the protrusion 110 may be positioned in the lock hole 610, and the protrusion 112 may be positioned in the lock hole 612. To illustrate, the protrusions 110, 112 snap into the lock holes 610, 612 as the lighting module 100 is rotated after the locking cap 106 is inserted into the keyhole 602 shown in FIG. 6. The insertion or snapping of the protrusions 110, 112 into the lock holes 610, 612 may be used as an indication that the retention tabs 208, 210 are properly inserted through a keyhole 602 of the bracket 600 and rotated to a position above the bracket 600 to retain the module 100 attached to the bracket 600.

In some example embodiments, the insertion or snapping of the protrusions 110, 112 into the lock holes 610, 612 may also indicate that the lighting module 100 is attached to the retention bracket 600 in a position that allows efficient thermal and optical performance of the lighting module 100.

Figure 9:
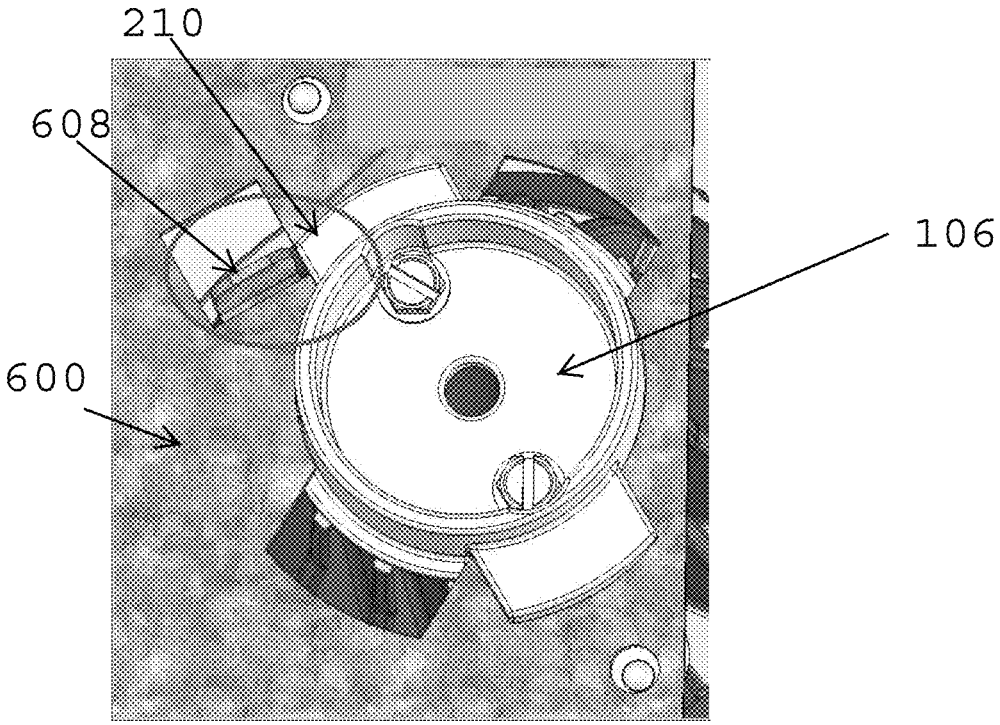
FIG. 9 illustrates a top view of the lighting module of FIG. 1 attached to the retention bracket of FIG. 6 according to an example embodiment.

FIG. 9 illustrates a top view of the lighting module of FIG. 1 attached to the retention bracket of FIG. 6 according to an example embodiment. The lighting structure including the lighting module 100 and the retention bracket 600 may be attached to a housing or a similar structure. As illustrated in FIG. 9, the lighting module 100 has been rotated and locked into a desired position such as a position that allows efficient thermal and optical performance of the lighting module 100.

In some example embodiments, the stop tab 608 is positioned to prevent over-rotation of the lighting module 100. For example, if a user attempts to further rotate the lighting module 100 counterclockwise, the stop tab 608 may come in contact with the retention tab 210 and prevent the rotation. Thus, the user may stop further attempts to rotate the lighting module 100 counterclockwise. By preventing over-rotation of the lighting module 100, the stop tab 608 may help a user to correctly attach of the lighting module 100 to the retention bracket 600. In some alternative embodiments, the stop tab 608 may be located in a different location than shown in FIG. 9 or may be omitted.

Figure 10A:
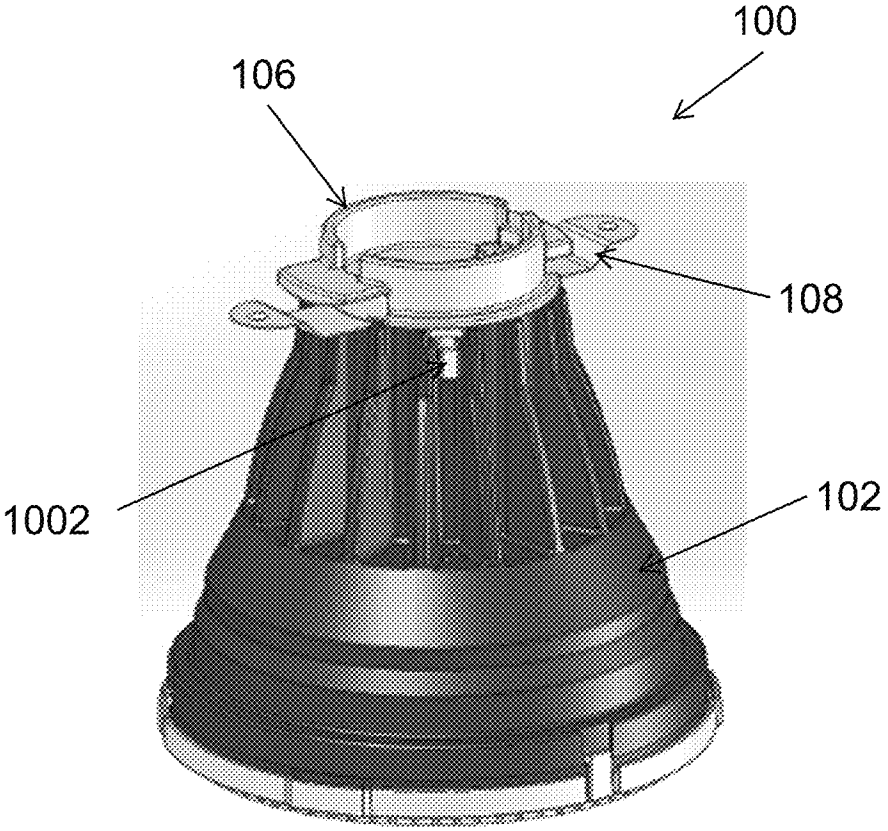
FIGS. 10A-10C illustrate the PAR lamp styled lighting module including a thermal protector according to an example embodiment.
Figure 10B:
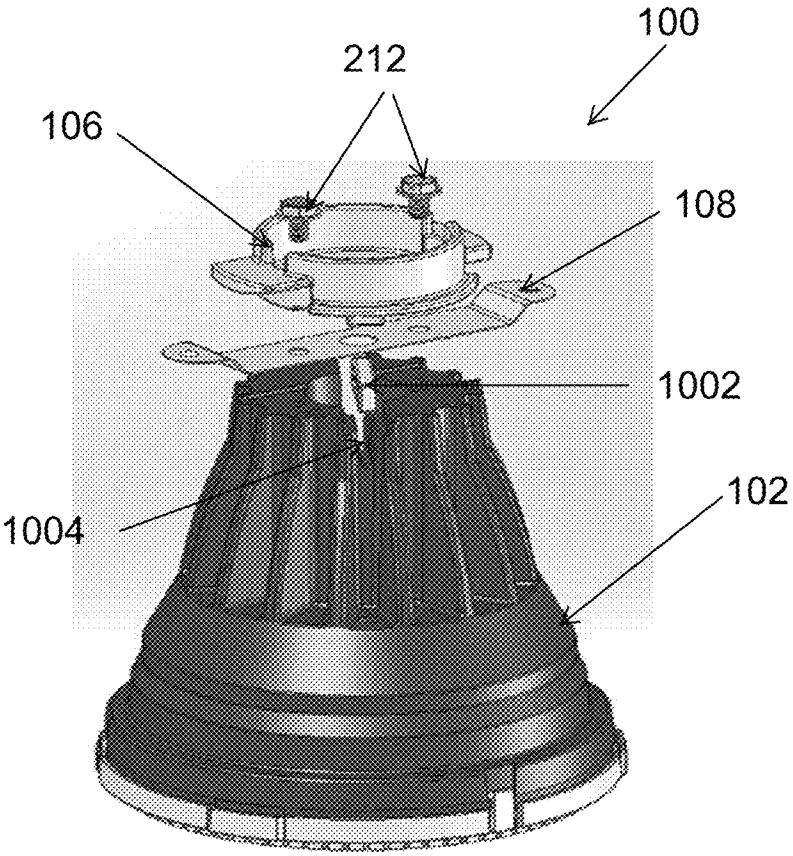
Figure 10C:
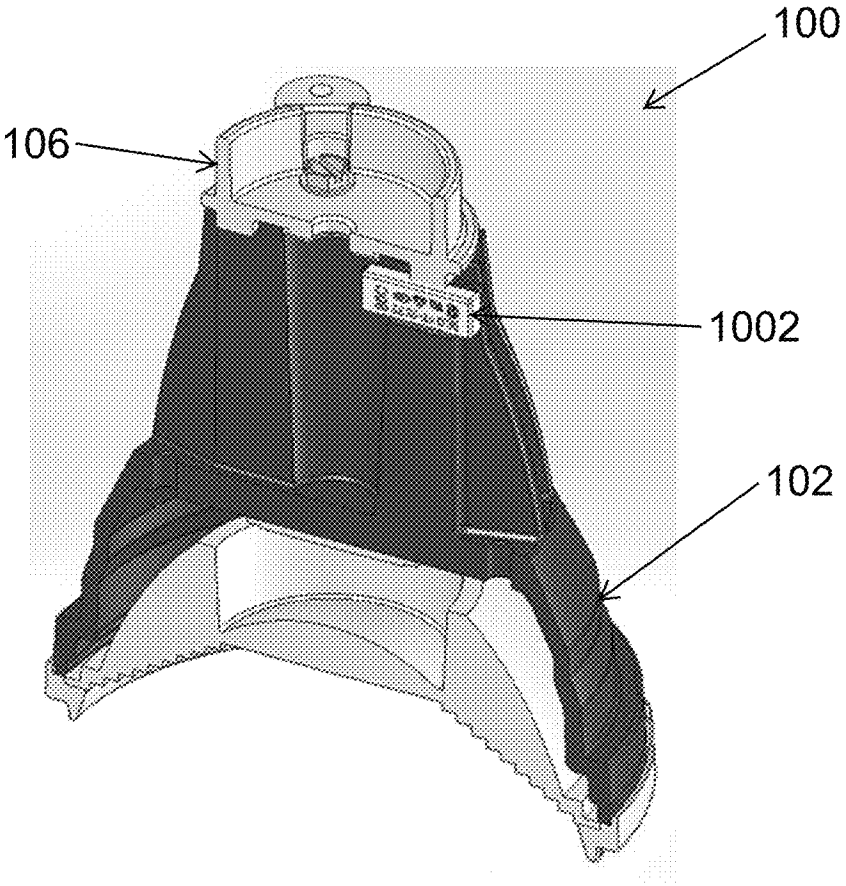

FIGS. 10A-10C illustrate the PAR lamp styled lighting module 100 including a thermal protector 1002 according to an example embodiment. The thermal protector 1002 is a thermally operated snap action device containing a bimetal component inside a plastic or metal housing. The thermal protector 1002 may include wires to attach the thermal protector to an electrical circuit.

The thermal protector 1002 is designed to protect the LED 506 (shown in FIG. 5) from exceeding its thermal limit, thereby preventing thermal damage to the LED 506. To illustrate, the thermal protector 1002 interrupts the electrical path from a power source, such as a driver, to the LED 506 when the thermal rating of the LED 506 is reached. The interruption of the electrical path to the LED 506 removes power from the LED 506 resulting in the cooling down of the LED 506. The thermal protector 506 automatically resets itself to allow power to reach the LED 506 once the LED 506 has cooled down. The thermal protector 1002 may interrupt power to the LED 506 based on the temperature of the heat sink 102 which correlates to the temperature of the LED 506.

To illustrate, the thermal protector 1002 may be inserted into a groove 1004 in the upper end of the heat sink 102. For example, the tolerances of the width of the groove 1004 may be tight in relation to the thickness of the thermal protector 1002 to provide a good surface contact between heat sink 102 and the thermal protector 1002.

In some example embodiments, after the thermal protector 1002 is positioned in the groove 1004 of the heat sink 102, the thermal protector 1002 may be held in place by the locking cap 1006 of the lighting module 100. For example, the locking cap 106 may clamp the thermal protector 1002 within the groove 1004 of the heat sink 102 to prevent a movement relative to the groove 1004. Wiring connection to the electrical circuit of the LED may be made within the interior of the heat sink 1002.

Although particular embodiments have been described herein, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A lighting module, comprising:

a heat sink;

a locking cap coupled to the heat sink at one end of the heat sink, the locking cap having a first retention tab and a second retention tab that are designed to retain the lighting module attached to a retention bracket, wherein the first retention tab and the second retention tab extend radially outward from a perimeter of the locking cap and wherein the first retention tab and the second retention tab are spaced from the heat sink;

a light emitting diode (LED) light source positioned in a cavity of the heat sink; and an optic positioned in the cavity of the heat sink and designed to direct light emitted by the LED light source.

2. The lighting module of claim 1, further comprising a retention spring, wherein a middle portion of the retention spring is positioned between the locking cap and the heat sink, wherein a first end portion of the retention spring and a second end portion of the retention spring extend out on opposite sides of the locking cap.

3. The lighting module of claim 2, wherein the first end portion of the retention spring includes a first protrusion, wherein the second end portion of the retention spring includes a second protrusion, and wherein the first protrusion and the second protrusion protrude upward away from the heat sink.

4. The lighting module of claim 2, wherein the first end portion of the retention spring and the second end portion of the retention spring are offset upward relative to the middle portion of the retention spring.

5. The lighting module of claim 1, wherein the locking cap and the heat sink each include an opening to route one or more electrical wires that are used to provide power to the LED light source.

6. The lighting module of claim 1, further comprising an optic holder designed to retain the optic attached to the heat sink.

7. The lighting module of claim 1, wherein the first retention tab and the second retention tab extend out horizontally in opposite direction from the lighting module.

8. The lighting module of claim 1, wherein the heat sink has a shape similar to a PAR 30 lamp.

9. A lighting module, comprising:

a heat sink;

a locking cap coupled to the heat sink at one end of the heat sink, the locking cap having a first retention tab and a second retention tab that are designed to retain the lighting module attached to a retention bracket, wherein the first retention tab and the second retention tab extend radially outward from a perimeter of the locking cap and wherein the first retention tab and the second retention tab are spaced from the heat sink;

a light emitting diode (LED) light source positioned in a cavity of the heat sink; and a retention spring, wherein a middle portion of the retention spring is positioned between the locking cap and the heat sink, wherein a first end portion of the retention spring and a second end portion of the retention spring extend out on opposite sides of the locking cap.

10. The lighting module of claim 9, further comprising an optic positioned in the cavity of the heat sink and designed to direct light emitted by the LED light source.

11. The lighting module of claim 10, further comprising an optic holder designed to retain the optic attached to the heat sink, wherein the optic is a removable optic.

12. The lighting module of claim 9, wherein the first end portion of the retention spring includes a first protrusion, wherein the second end portion of the retention spring includes a second protrusion, and wherein the first protrusion and the second protrusion protrude upward away from the heat sink.

13. The lighting module of claim 9, wherein the first end portion of the retention spring and the second end portion of the retention spring are offset upward relative to the middle portion of the retention spring.

14. The lighting module of claim 9, wherein the locking cap and the heat sink each include an opening to route one or more electrical wires that are used to provide power to the LED light source.

15. A lighting structure, comprising:

a retention bracket; and a lighting module attached to the retention bracket, wherein the lighting module comprises:

a heat sink;

a locking cap coupled to the heat sink at one end of the heat sink, the locking cap extending through a keyhole in the retention bracket, wherein the locking cap includes a first retention tab and a second retention tab that are disposed on a top side of the retention bracket and retain the lighting module attached to the retention bracket, wherein the first retention tab and the second retention tab extend radially outward from a perimeter of the locking cap and wherein the first retention tab and the second retention tab are spaced from the heat sink;

a light emitting diode (LED) light source positioned in a cavity of the heat sink; and an optic positioned in the cavity of the heat sink and designed to direct light emitted by the LED light source.

16. The lighting structure of claim 15, further comprising a retention spring, wherein a middle portion of the retention spring is positioned between the locking cap and the heat sink, wherein a first end portion of the retention spring and a second end portion of the retention spring extend out on opposite sides of the locking cap and are pressed against the retention bracket on a bottom side of the retention bracket, wherein the top side and the bottom side are opposite sides of the retention bracket.

17. The lighting structure of claim 16, wherein the first end portion of the retention spring includes a first protrusion, wherein the second end portion of the retention spring includes a second protrusion, wherein the first protrusion is positioned in a first lock hole formed in the retention bracket, and wherein the second protrusion is positioned in a second lock hole formed in the retention bracket.

18. The lighting structure of claim 15, wherein the retention bracket includes a stop tab that prevents over-rotation of the lighting module.

19. The lighting structure of claim 15, wherein the locking cap and the heat sink each include an opening to route one or more electrical wires that are used to provide power to the LED light source.

20. The lighting structure of claim 15, further comprising an optic holder designed to retain the optic attached to the heat sink, wherein the optic is a removable optic.

* * * * *